US007768370B2

(12) United States Patent
Brown

(10) Patent No.: US 7,768,370 B2
(45) Date of Patent: Aug. 3, 2010

(54) METHOD AND APPARATUS FOR MOUNTING A CIRCUIT BOARD TO A TRANSFORMER

(75) Inventor: Michael J. Brown, Kitchener (CA)

(73) Assignee: Hammond Power Solutions, Inc., Guelph, Ontario (CA)

( * ) Notice: Subject to any disclaimer, the term of this patent is extended or adjusted under 35 U.S.C. 154(b) by 183 days.

(21) Appl. No.: 11/846,921

(22) Filed: Aug. 29, 2007

(65) Prior Publication Data

US 2009/0058586 A1 Mar. 5, 2009

(51) Int. Cl.

| | |
|---|---|
| ***H01F 27/02*** | (2006.01) |
| ***H01F 5/00*** | (2006.01) |
| ***H01F 27/28*** | (2006.01) |
| ***H01F 17/04*** | (2006.01) |

(52) U.S. Cl. ..... 336/90; 336/200; 336/220; 336/222; 336/223; 336/232

(58) Field of Classification Search ..... 336/90, 336/200, 220, 221, 222, 223, 232
See application file for complete search history.

(56) References Cited

U.S. PATENT DOCUMENTS

| | | | | |
|---|---|---|---|---|
| 3,914,658 A | | 10/1975 | Thomas et al. | |
| 4,519,015 A | | 5/1985 | Lin | |
| 4,652,975 A | | 3/1987 | Scott | |
| 4,761,628 A | * | 8/1988 | Nishi et al. | 336/180 |
| 4,939,623 A | * | 7/1990 | Equi et al. | 361/752 |
| 5,272,459 A | * | 12/1993 | Geery | 336/61 |
| 5,281,154 A | * | 1/1994 | Comerci et al. | 439/107 |
| 5,413,504 A | * | 5/1995 | Kloecker et al. | 439/620.03 |
| 5,751,555 A | | 5/1998 | Pfizenmayer et al. | |
| 5,805,431 A | * | 9/1998 | Joshi et al. | 361/836 |
| 5,847,933 A | | 12/1998 | Lostumo et al. | |
| 6,380,836 B2 | * | 4/2002 | Matsumoto et al. | 336/200 |
| 7,601,030 B2 | * | 10/2009 | Patel | 439/620.3 |

* cited by examiner

*Primary Examiner*—Elvin G Enad
*Assistant Examiner*—Ronald W Hinson
(74) *Attorney, Agent, or Firm*—Quarles & Brady LLP; George E. Haas

(57) ABSTRACT

An electromagnetic assembly which has a base, at least one winding, and a magnetic core connected to the base, where at least one winding is mounted on the magnetic core. A housing part encloses at least part of at least one winding, and a printed circuit board is mounted to the housing part. The electromagnetic assembly can be a transformer or inductor, for example.

26 Claims, 5 Drawing Sheets

METHOD AND APPARATUS FOR MOUNTING A CIRCUIT BOARD TO A TRANSFORMER

FIELD OF THE INVENTION

The present invention relates to transformers and/or other similar electromagnetic assemblies such as inductors, and more particularly, to such electromagnetic assemblies with a circuit board mounted thereon, and a specific method for that mounting.

BACKGROUND OF THE INVENTION

It is very common to install small transformers and inductors onto a printed circuit boards. The use of printed circuit boards reduces assembly labor and provides for a compact area for connection to components such as terminal blocks, edge connectors, resistors, capacitors, inductors, voltage regulators, transistors, silicon controlled rectifiers (SCRs), diodes, fuses, light emitting diode (LED) lights, etc.

In some electrical systems, such as a programmable logic controller (PLC) or variable frequency drive (VFD) for example, printed circuit boards are typically installed inside an enclosed device and are not normally accessible by the installer. In such systems, a transformer can be mounted on the circuit board, but this is suitable for small transformers only. Control, and other, transformers which are used in such systems are typically to large to mount on a circuit board, but nonetheless need connection thereto.

What is needed in the art is a method and apparatus for mounting a circuit board to a transformer or other electromagnetic assembly.

SUMMARY OF THE INVENTION

The invention comprises, in one form thereof, an electromagnetic assembly which has a base, at least one winding, and a magnetic core connected to the base, where at least one winding is mounted on the magnetic core. A housing part encloses at least part of at least one winding, and a printed circuit board is mounted to the housing part.

The invention comprises, in another form thereof, a transformer which has a primary winding with a plurality of primary winding taps, a secondary winding with a plurality of secondary winding taps, and a magnetic core on which the primary winding and the secondary winding are mounted. The primary winding and the secondary winding are electromagnetically coupled through the core. A housing part encloses at least part of the primary winding and/or the secondary winding, and a printed circuit board is mounted to the housing part.

The invention comprises, in yet another form thereof, an electrical system which includes a controller with at least one electrical load component and a transformer connected to the electrical load component. The transformer has a primary winding with a plurality of primary winding taps, a secondary winding with a plurality of secondary winding taps, and a magnetic core on which the primary winding and the secondary winding are mounted. The primary winding and the secondary winding are electromagnetically coupled through the core. A housing part encloses at least part of the primary winding and/or the secondary winding, and a printed circuit board is mounted to the housing part.

The invention comprises, in yet another form thereof, a method of manufacturing a transformer which includes the steps of providing a primary winding having a plurality of primary winding taps, a secondary winding including a plurality of secondary winding taps, and a magnetic core on which the primary winding and the secondary winding are mounted, the primary winding and the secondary winding being electromagnetically coupled through the core; enclosing at least part of at least one of the primary winding and the secondary winding with a housing part; and mounting a printed circuit board to the housing part.

An advantage of an embodiment of the present invention is that it allows for the use of printed circuit board compatible components such as terminal blocks, fuse clips, diodes, voltage regulators, etc., to be used on transformers, or other similar electromagnetic assemblies such as inductors.

Another advantage of an embodiment of the present invention is that it reduces transformer assembly time by utilizing the manufacturing efficiency of printed circuit boards.

Yet another advantage of an embodiment of the present invention is that it ensures minimum electrical clearances are maintained by relying on the dimensional accuracy of a printed circuit board assembly.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

In general, the present invention relates to transformers and other electromagnetic devices such as inductors, toroids, etc., which include windings mounted on a core which can be achieved by a variety of means which are well known, see for example Leander W. Matsch, Electromagnetic and Electromechanical Machines, 2nd edition, 1977, IEP, New York, and/or www.hammondpowersolutions.com, incorporated herein by reference, although the present invention is not limited by the constructions described by these references, and can also include other winding and core configurations as are known, and other transformer types. For example, some or all of the claimed structure of the present invention can be used in control transformer, a stepup or stepdown transformer, an isolation transformer and/or an autotransformer.

Figure 1:
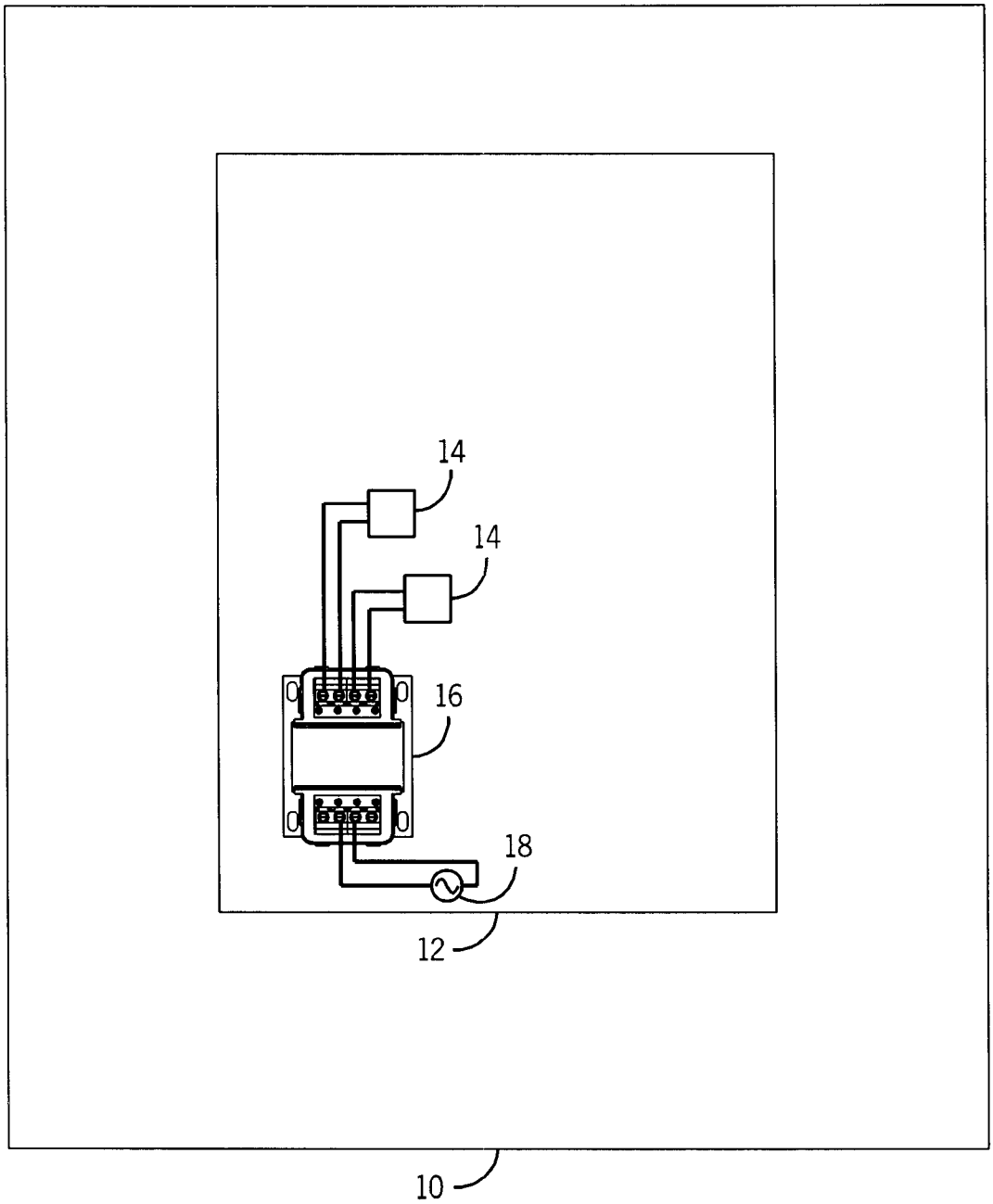
FIG. 1 is a schematic view of an embodiment of an electrical system including a an electromagnetic device in the form of a transformer according to the present invention.

Referring now to FIG. 1, there is shown an electrical system 10 which includes a controller 12 which has at least one electrical load component 14. For example, controller 12 can be programmable logic controller, a variable frequency drive, a motor control center, a control panel or other types of control systems. Electrical load components 14 can be relays, motors, contactors, and other electrical devices, for example. An electromagnetic assembly such as transformer 16 according to the present invention is connected to electrical load component(s) 14, and to a source of electrical power 18. Electrical system 10, controller 12 and electrical load component 14 are shown schematically in FIG. 1 as they are generally known.

Figure 2:
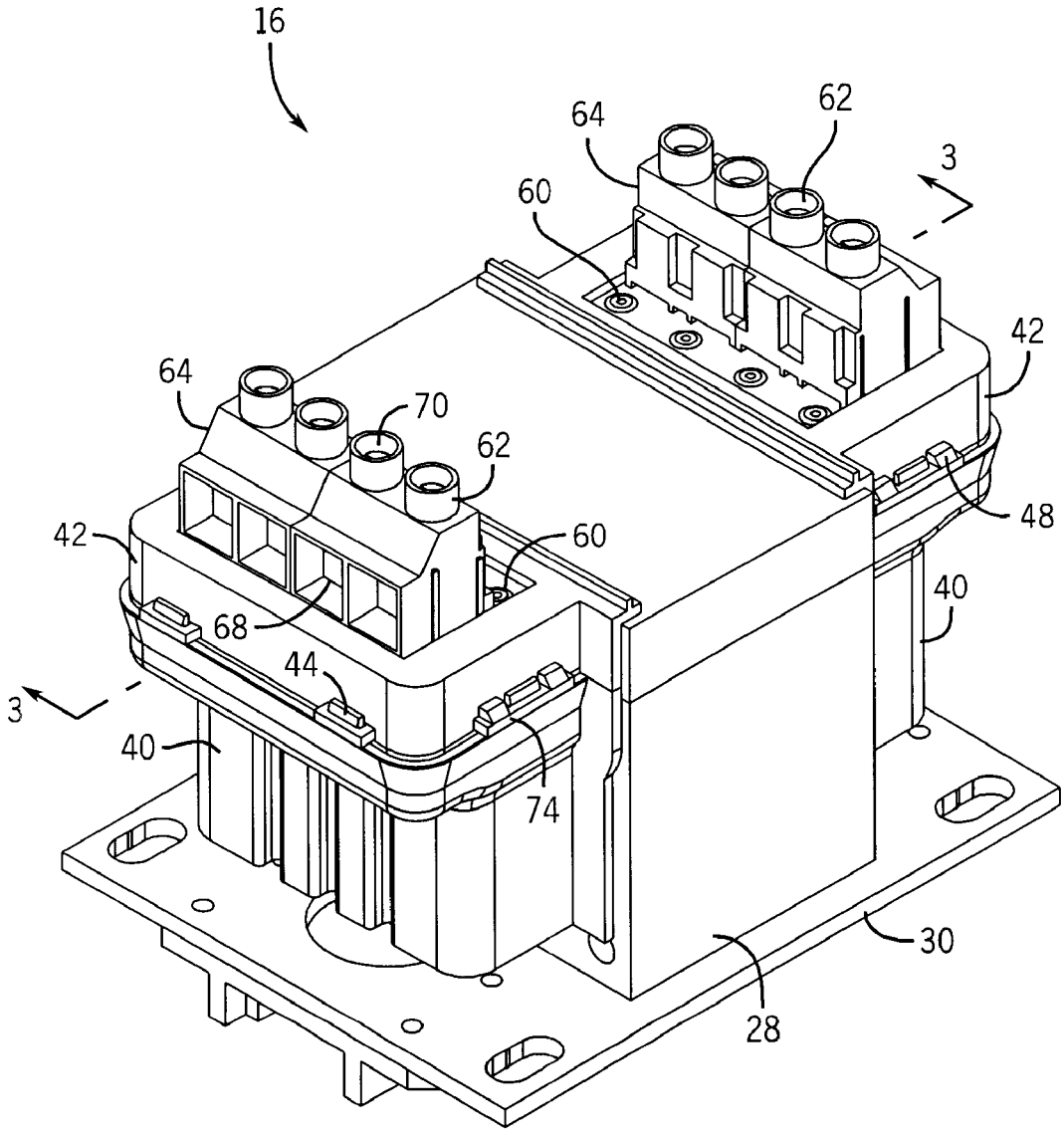
FIG. 2 is a perspective view of the transformer shown in the electrical system of FIG. 1.
Figure 3:
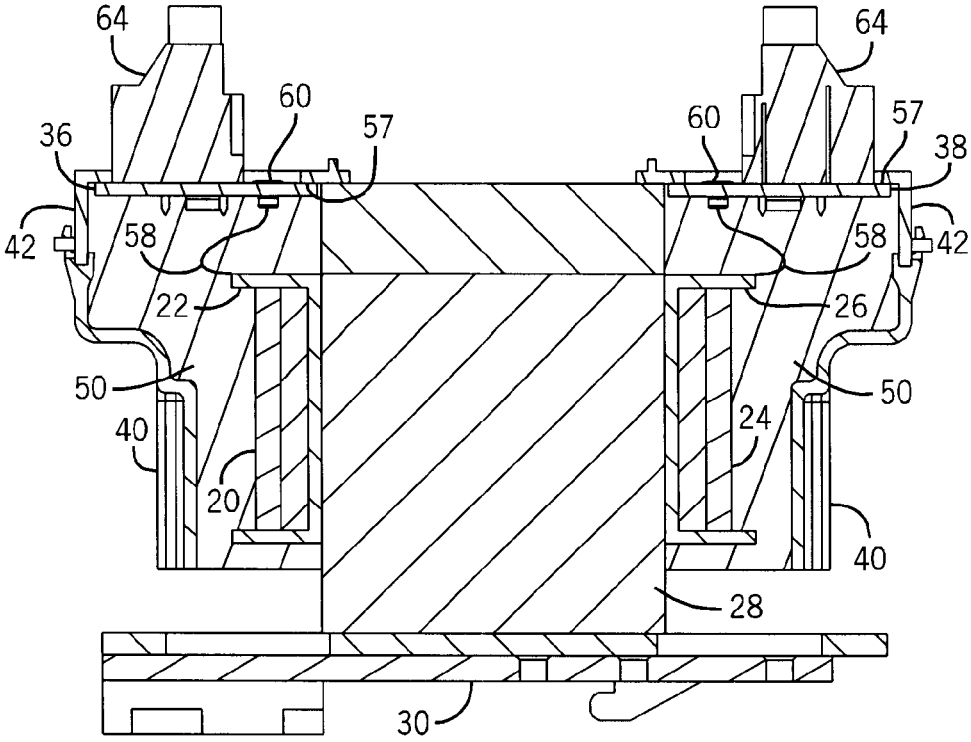
FIG. 3 is a cross-sectional view taken along section line 3-3 in FIG. 2.
Figure 4:
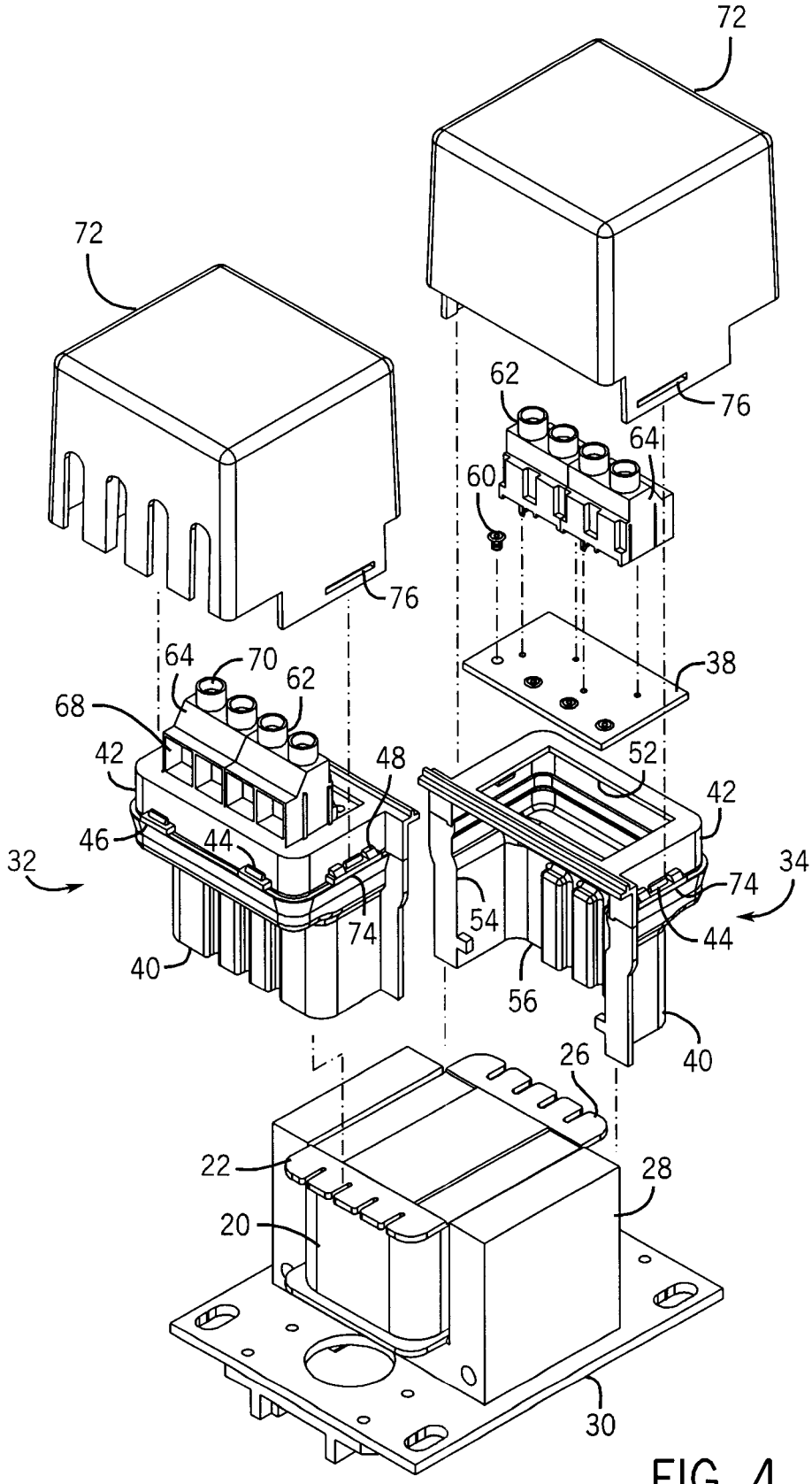
FIG. 4 is an exploded perspective view of the transformer of FIG. 2, and also shown with two finger guards exploded therefrom.

Referring more particularly to FIGS. 2-4, transformer 16 includes a first winding 20, which can be a primary winding for example, including a plurality of first winding taps 22. A second winding 24, which can be a secondary winding, includes a plurality of second winding taps 26. Alternatively, winding 22 can be a secondary winding and winding 24 can be a primary winding. Transformer 16 has a magnetic core 28 on which the primary winding and the secondary winding are mounted, and the windings are electromagnetically coupled through core 28. Core 28, and windings 20, 24, are mounted on base 30.

Referring more particularly to FIGS. 2-4, housing parts 32, 34 enclose at least part of respective windings 20, 24, and printed circuit boards 36, 38 are mounted to respective housing parts 32, 34. Each of housing parts 32, 34 can include a bottom part 40 and a top part 42 which can snap together at ramped projections 44 and clips 46, 48, although the housing parts alternatively can be of a single piece design. A potting material 50 is at least partially enclosed within respective housing parts 32, 34 and supports respective printed circuit boards 36, 38. Potting material 50 can be an epoxy, polyester, resin compound, or similar material, for example.

In the embodiment shown, each of housing parts 32, 34 are an approximately three sided enclosure defining a first opening 52, a second opening 54 and a third opening 56. Further, three sided enclosures 32, 34 can comprise a step structure as shown where the lower extent of bottom part 40 has a smaller "footprint" than the top part 42. This step structure adds strength to housing parts 32, 34, and accommodates a larger circuit board 36, 38. Circuit boards 36, 38 are mounted to respective first openings 52 and may be glued thereon at the underside 57 of top part 42, and a wire 58, or other, connection can be soldered between a respective winding taps 22, 26, and respective circuit board connectors 60. Conductive traces on the circuit boards electrically connect respective connectors 60 to respective terminals 62 on terminal board 64. Potting material 50 can be injected at third opening 56 of respective housing parts 32, 34 which then provides a continuous support and backing for respective printed circuit boards 36, 38.

Circuit boards 36, 38 can be a single sided, double sided, or multilayer circuit board. In addition to terminal boards 64, each of circuit boards 36, 38 can have mounted thereon edge connectors, resistors, capacitors, inductors, voltage regulators, transistors, SCRs, diodes, fuses, fuse clips, light emitting diodes, integrated circuits, and other electronic/electrical components as are know. Terminal board 64 can be an array of stovepipe terminals 62 in which a wire can be inserted through an opening 68 and secured with a compression screw at opening 70.

The present invention can include finger guards 72 at least partially covering circuit boards 36, 38. Each of finger guards 72 can be in a snap fit arrangement with a corresponding housing part 32 or 34. The snap fit arrangement can comprise at least one lateral protrusion 74 (two on the embodiment shown, one on each side) on the housing part, and at least one corresponding finger guard aperture 76 (also two on the embodiment shown, one on each side) in each finger guard 76.

Although the electromagnetic assembly 16 of FIGS. 1-4 is shown as a transformer, it could alternatively be an inductor, or a toroid, or other electromagnetic assemblies which include a core with a winding supported thereon.

Figure 5:
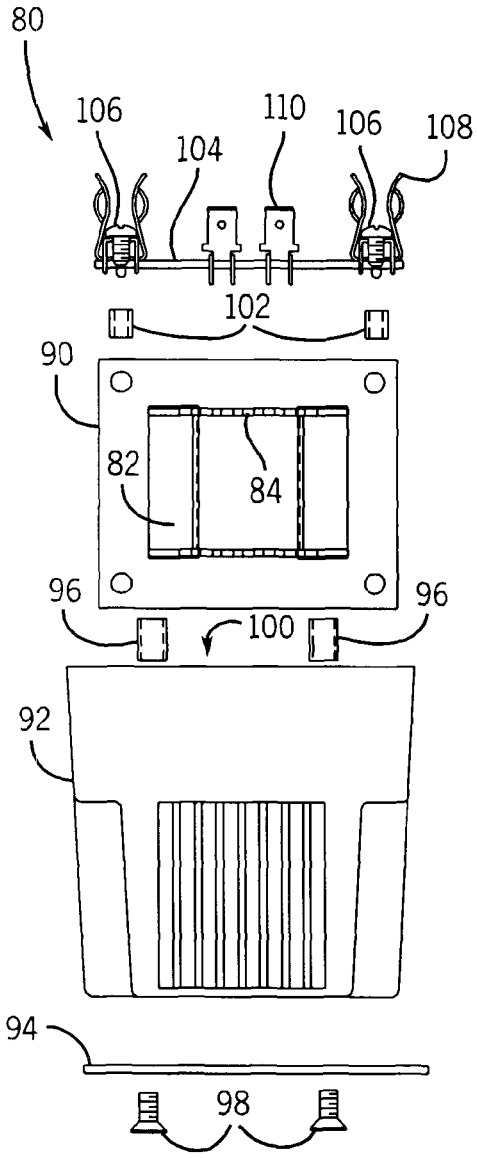
FIG. 5 is an exploded side view of an embodiment of an electromagnetic device in the form of another transformer according to the present invention.
Figure 6:
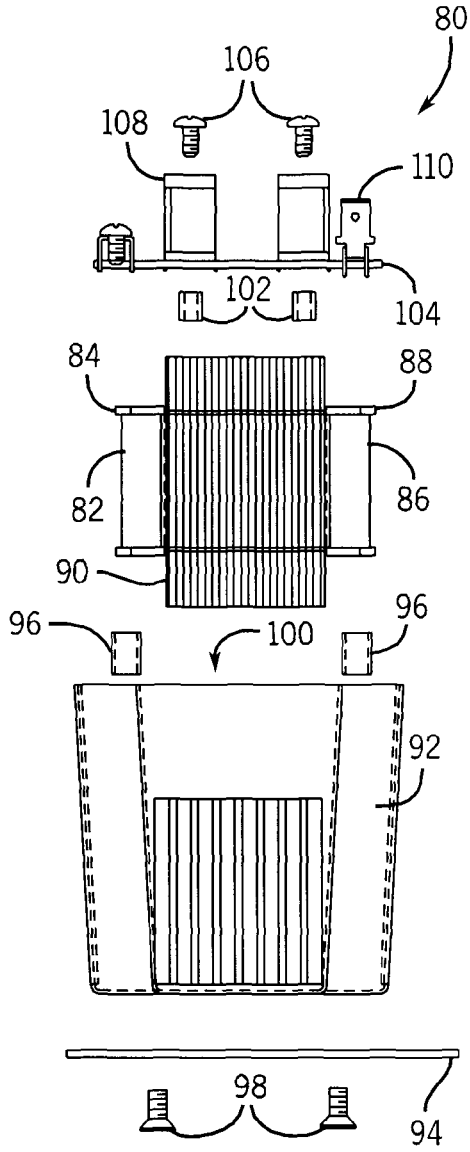
FIG. 6 is an exploded end view of the transformer of FIG. 5.

In the embodiment of FIGS. 5-6, transformer 80 includes a first winding 82, which can be a primary winding for example, including a plurality of first winding taps 84. A second winding 86, which can be a secondary winding, includes a plurality of second winding taps 88. Alternatively, winding 82 can be a secondary winding and winding 86 can be a primary winding. Transformer 80 has a magnetic core 90 on which the primary winding and the secondary winding are mounted, and windings 82, 86 are electromagnetically coupled through core 90. Core 90, and windings 82, 86, are at least partially enclosed within housing 92, which is mounted on base 94 using threaded inserts 96 and screw fasteners 98.

Housing 92 is an approximately five sided enclosure defining a single opening 100 at the top thereof, or in other words, housing 92 is an open ended cup. In order to assemble the transformer, the core 90 and windings 82, 86 assembly are placed in cup 92, with threaded inserts 102, and the remainder of cup 92 is filled with a potting material such as an epoxy, polyester, resin compound, or similar material, for example, and allowed to cure. Attach printed circuit board 104 to the cured potting material with screws 106, clips or rivets or other fasteners, and solder or screw the transformer lead connections (from the winding taps) to the printed circuit board 104 assembly. As with circuit board assemblies 36, 38, printed circuit board assembly 104 can be a single sided, double sided, or multilayer circuit board. In addition, printed circuit board assembly 104 can include terminal boards 64, edge connectors, resistors, capacitors, inductors, voltage regulators, transistors, SCRs, diodes, fuses, fuse clips 108, other connectors 110, light emitting diodes, integrated circuits, and other electronic/electrical components as are know.

While example embodiments and applications of the present invention have been illustrated and described, including a preferred embodiment, it is to be understood that the invention is not limited to the precise configuration and resources described above. Various modifications, changes, and variations apparent to those skilled in the art may be made in the arrangement, operation, and details of the methods and systems of the present invention disclosed herein without departing from the scope of the claimed invention.

I claim:

1. A transformer, comprising:

a primary winding including a plurality of primary winding taps;

a secondary winding including a plurality of secondary winding taps;

a magnetic core on which the primary winding and the secondary winding are mounted, the primary winding and the secondary winding being electromagnetically coupled through the core, wherein the magnetic core has a first side from which the plurality of primary winding taps project, and a second side from which the plurality of secondary winding taps project;

a first housing part abutting the first side of the magnetic core and into which the primary winding extends;

a second housing part abutting the second side of the magnetic core and into which the secondary winding extends;

a first printed circuit board mounted to the first housing part; and a second printed circuit board mounted to the second housing part.

2. The transformer of claim 1, further including a potting material at least partially enclosed within the first housing part and the second housing part, and supporting the first printed circuit board and the second printed circuit board.

3. The transformer of claim 1, wherein each of the first housing part and the second housing part comprises an enclosure having a plurality of walls defining at least one opening

4. The transformer of claim 1, further including a first plurality of terminals mounted on the first circuit board; and a second plurality of terminals mounted on the second circuit board.

5. The transformer of claim 3, wherein the first circuit board is mounted to at least partially cover the at least one opening in the first housing part.

6. The transformer of claim 5 further comprising a potting material abutting and at least partially filling the first housing part and supporting the first printed circuit board.

7. The transformer of claim 3, wherein the second circuit board is mounted to at least partially cover the at least one opening in the second housing part.

8. The transformer of claim 7 further comprising a potting material abutting and at least partially filling the second housing part and supporting the second printed circuit board.

9. The transformer of claim 1, further comprising a controller including at least one electrical load component.

10. A transformer, comprising:

a first winding including a first plurality of winding taps;

a second winding including a second plurality of winding taps;

a magnetic core on which the first winding and the second winding are mounted, the first winding and the second winding being electromagnetically coupled through the core, wherein the magnetic core has a first side from which the first winding projects;

a first housing part abutting the first side of the magnetic core, and having a first opening through which the first winding projects and having a second opening; and a first printed circuit board mounted to the first housing part at least partially covering the second opening, and electrically connected to the first plurality of winding taps.

11. The transformer of claim 10, further comprising a potting material filling the first housing part and abutting the first printed circuit board.

12. The electromagnetic assembly of claim 10, wherein the first housing part is an approximately three sided enclosure defining the first opening, the second opening, and a third opening.

13. The electromagnetic assembly of claim 12, wherein the three sided enclosure comprises a step structure.

14. The electromagnetic assembly of claim 12, wherein the first circuit board is mounted across one of the first opening, a second opening and a third opening, and a potting material is injected into another of the first opening, a second opening and a third opening

15. The electromagnetic assembly of claim 10, further comprising a plurality of terminals mounted on the first circuit board.

16. The electromagnetic assembly of claim 15, wherein the plurality of terminals is an array of stovepipe terminals.

17. The electromagnetic assembly of claim 10, further comprising at least one finger guard at least partially covering the first circuit board.

18. The electromagnetic assembly of claim 17, wherein the at least one finger guard is in a snap fit arrangement with the first housing part.

19. The electromagnetic assembly of claim 18, wherein said snap fit arrangement comprises at least one lateral protrusion on the first housing part, and at least one corresponding finger guard aperture in the at least one finger guard.

20. The transformer of claim 10, wherein the magnetic core has a second side from which the second winding extends; and further comprising a second housing part abutting the second side of the magnetic core and having a primary opening through which the second winding projects.

21. The transformer of claim 20, further comprising second printed circuit board mounted to the second housing part.

22. The transformer of claim 21, further comprising a potting material filling the second housing part and abutting the second printed circuit board.

23. The transformer of claim 21, wherein the second housing part has a secondary opening; and the second circuit board is mounted to at least partially cover the secondary opening

24. A method of manufacturing a transformer, comprising the steps of:

mounting a primary winding and a secondary winding on a magnetic core so that the primary winding and the secondary winding are electromagnetically coupled through the core, wherein the primary winding includes a plurality of primary winding taps projecting from a first side of the core, and wherein the secondary winding includes a plurality of secondary winding taps projecting from a second side of the core;

mounting a first housing part in contact with the first side of the core wherein the primary winding projects through an opening in the first housing part;

electrically connecting a first printed circuit board to the plurality of primary winding taps;

mounting the first printed circuit board to the first housing part;

mounting a second housing part in contact with the second side of the core wherein the secondary winding projects through an opening in the second housing part; and electrically connecting a second printed circuit board to the plurality of secondary winding taps; and mounting the second printed circuit board to the second housing part.

25. The method of claim 24, further comprising the step of supporting the first printed circuit board with potting material that contacts the first housing part; and supporting the second printed circuit board with potting material that contacts the second housing part.

26. The method of claim 24, further comprising:

filling the first housing part with a potting material that abuts the plurality of primary winding taps and the first printed circuit board; and filling the second housing part with a potting material that abuts the plurality of secondary winding taps and the second printed circuit board.

* * * * *

UNITED STATES PATENT AND TRADEMARK OFFICE

CERTIFICATE OF CORRECTION

PATENT NO. : 7,768,370 B2
APPLICATION NO. : 11/846921
DATED : August 3, 2010
INVENTOR(S) : Michael J. Brown It is certified that error appears in the above-identified patent and that said Letters Patent is hereby corrected as shown below:

In column 5, line 48, change “electromagnetic assembly” to --transformer--.

In column 5, line 52, change “electromagnetic assembly” to --transformer--.

In column 5, line 54, change “electromagnetic assembly” to --transformer--.

In column 5, line 59, change “electromagnetic assembly” to --transformer--.

In column 6, line 1, change “electromagnetic assembly” to --transformer--.

In column 6, line 3, change “electromagnetic assembly” to --transformer--.

In column 6, line 6, change “electromagnetic assembly” to --transformer--.

In column 6, line 9, change “electromagnetic assembly” to --transformer--.

Signed and Sealed this
Seventeenth Day of July, 2012

David J. Kappos

David J. Kappos
*Director of the United States Patent and Trademark Office*